US011493277B2

(12) United States Patent
Joardar et al.

(10) Patent No.: US 11,493,277 B2
(45) Date of Patent: Nov. 8, 2022

(54) MICROCHANNEL HEAT EXCHANGER

(71) Applicant: Carrier Corporation, Palm Beach Gardens, FL (US)

(72) Inventors: Arindom Joardar, Jamesville, NY (US); Robert A. Leffler, Boston, MA (US); Thomas Bryant, Brewerton, NY (US); Jon P. Kennedy, Syracuse, NY (US); Kevin Mercer, Danville, IN (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 17/078,443

(22) Filed: Oct. 23, 2020

(65) Prior Publication Data

US 2021/0131736 A1 May 6, 2021

Related U.S. Application Data

(60) Provisional application No. 62/931,425, filed on Nov. 6, 2019.

(51) Int. Cl.
*F28D 1/053* (2006.01)
*F28F 9/02* (2006.01)

(52) U.S. Cl.
CPC ..... *F28D 1/05391* (2013.01); *F28F 9/0273* (2013.01); *F28F 2260/02* (2013.01)

(58) Field of Classification Search
CPC ..... F28D 1/05391; F28D 1/05366; F28F 9/0273; F28F 2260/02; F28F 9/0209; F28F 9/027
USPC ..... 165/172
See application file for complete search history.

(56) References Cited

U.S. PATENT DOCUMENTS 1,684,083 A * 9/1928 Bloom ..... F28D 1/04 62/525
3,612,172 A 10/1971 Dohnt
3,976,128 A * 8/1976 Patel ..... F25B 39/02 165/153
4,168,742 A 9/1979 Kluppel
4,485,642 A 12/1984 Karns
5,279,360 A 1/1994 Hughes
(Continued)

FOREIGN PATENT DOCUMENTS

CN 201652995 11/2010
CN 109631419 4/2019
(Continued)

*Primary Examiner* — Tho V Duong
*Assistant Examiner* — Raheena R Malik
(74) *Attorney, Agent, or Firm* — Carlson, Gaskey & Olds, P.C.

(57) ABSTRACT

A heat exchanger assembly includes a plurality of flattened heat exchanger tubes. The plurality of heat exchanger tubes include a bend that separates the plurality of heat exchanger tubes between extending in a first plane and extending in a second plane transverse to the first plane. An inlet manifold is in fluid communication with the plurality of heat exchanger tubes and includes a distribution insert at least partially extending through an inlet opening in the inlet manifold. An outlet manifold is in fluid communication with the plurality of heat exchanger tubes and includes an outlet opening spaced inward from opposing ends of the outlet manifold.

16 Claims, 6 Drawing Sheets

(56) References Cited

U.S. PATENT DOCUMENTS 5,534,202 A * 7/1996 Roberts ..... B01D 24/24 261/122.1
5,613,554 A 3/1997 Bull
5,910,167 A * 6/1999 Reinke ..... F25B 39/028 62/525
6,550,257 B1 4/2003 Goetzinger
7,331,195 B2 * 2/2008 Bae ..... F25B 39/02 165/174
7,363,962 B2 4/2008 Cleland
7,523,781 B2 4/2009 Oh
7,921,904 B2 4/2011 Matter
8,091,620 B2 * 1/2012 Gorbounov ..... F28D 1/0475 165/173
8,184,435 B2 * 5/2012 Bean, Jr ..... H05K 7/20745 361/696
8,413,715 B2 4/2013 Saito et al.
9,404,669 B2 8/2016 Mercer
9,752,833 B2 * 9/2017 Gao ..... F28F 9/0234
10,048,025 B2 * 8/2018 Wang ..... F28F 9/0273
2008/0093051 A1 * 4/2008 Rios ..... F25B 41/37 165/61
2008/0141525 A1 * 6/2008 Breiding ..... F28D 1/05391 29/726.5
2011/0240276 A1 * 10/2011 Wintersteen ..... F28D 1/05383 165/173
2011/0290465 A1 * 12/2011 Joshi ..... F28F 9/0273 165/175
2015/0219386 A1 8/2015 Zinger
2016/0169586 A1 * 6/2016 Ito ..... F28D 1/05391 165/104.21
2019/0154342 A1 5/2019 Jin

FOREIGN PATENT DOCUMENTS

CN 209181142 7/2019
EP 3159645 6/2018

* cited by examiner

MICROCHANNEL HEAT EXCHANGER

CROSS-REFERENCE TO RELATED APPLICATIONS

This application claims priority to U.S. Provisional Application No. 62/931,425, which was filed on Nov. 6, 2019 and is incorporated herein by reference.

BACKGROUND

The present disclosure relates to air conditioner, heat pump and refrigeration applications and, more particularly, to heat exchangers used in those systems.

Buildings, such as university buildings, office buildings, residential buildings, commercial buildings, and the like, include climate systems which are operable to control the climate inside the building. A typical climate system includes an evaporator, a compressor, a condenser, and an expansion valve. These components utilize a refrigerant to maintain an indoor temperature of the buildings at a desired level.

SUMMARY

In one exemplary embodiment, a heat exchanger assembly includes a plurality of flattened heat exchanger tubes. The plurality of heat exchanger tubes include a bend that separates the plurality of heat exchanger tubes between extending in a first plane and extending in a second plane transverse to the first plane. An inlet manifold is in fluid communication with the plurality of heat exchanger tubes and includes a distribution insert at least partially extending through an inlet opening in the inlet manifold. An outlet manifold is in fluid communication with the plurality of heat exchanger tubes and includes an outlet opening spaced inward from opposing ends of the outlet manifold.

In a further embodiment of any of the above, the inlet opening on the inlet manifold is located inward from opposing ends of the inlet manifold.

In a further embodiment of any of the above, the distribution insert includes an inlet portion that extends through a mid-portion of the inlet manifold.

In a further embodiment of any of the above, the inlet portion of the distribution insert divides into at least two branches that each extend towards a corresponding one of the opposing ends of the inlet manifold.

In a further embodiment of any of the above, the distribution insert includes a plurality of distribution orifices spaced along a length of the distribution insert.

In a further embodiment of any of the above, the inlet opening on the inlet manifold is located at a longitudinal end of the inlet manifold.

In a further embodiment of any of the above, an aluminum bodied expansion device is located at the inlet opening on the inlet manifold.

In a further embodiment of any of the above, the plurality of heat exchanger tubes are microchannel heat exchanger tubes.

In a further embodiment of any of the above, the first plurality of heat exchanger tubes define one of a "V" shape or a "U" shape with the bend.

In another exemplary embodiment, a heat exchanger assembly includes a housing that includes a first pair of opposing walls and a second pair of opposing walls. A heat exchanger assembly is at least partially located within the housing and includes a plurality of flattened heat exchanger tubes. The plurality of heat exchanger tubes include a bend that separates the plurality of heat exchanger tubes between extending in a first plane and extending in a second plane transverse to the first plane. An inlet manifold is in fluid communication with the plurality of heat exchanger tubes and includes a distribution insert at least partially extending through an inlet opening in an exterior of the inlet manifold. An outlet manifold is in fluid communication with the plurality of heat exchanger tubes and includes an outlet opening in an exterior of the outlet manifold and is spaced from opposing ends of the outlet manifold.

In a further embodiment of any of the above, opposing ends of the inlet manifold and the outlet manifold are located adjacent the first pair of opposing walls.

In a further embodiment of any of the above, a mid-portion of the outlet manifold is located adjacent one of the second pair of opposing walls.

In a further embodiment of any of the above, one of the first pair of walls includes an access panel.

In a further embodiment of any of the above, the distribution insert includes an inlet portion that extends through a mid-portion of the inlet manifold.

In a further embodiment of any of the above, the inlet portion of the distribution insert divides into at least two branches that each extend towards a corresponding one of the opposing ends of the inlet manifold.

In a further embodiment of any of the above, the inlet opening on the inlet manifold is located at an end of the inlet manifold.

In a further embodiment of any of the above, an expansion device is located at the inlet opening on the inlet manifold.

In a further embodiment of any of the above, the expansion device is an aluminum bodied expansion device.

In a further embodiment of any of the above, the plurality of heat exchanger tubes are microchannel heat exchanger tubes.

In a further embodiment of any of the above, the first plurality of heat exchanger tubes define one of a "V" shape or a "U" shape with the bend. The bend is located adjacent a drain pan in the housing.

DETAILED DESCRIPTION

Figure 1:
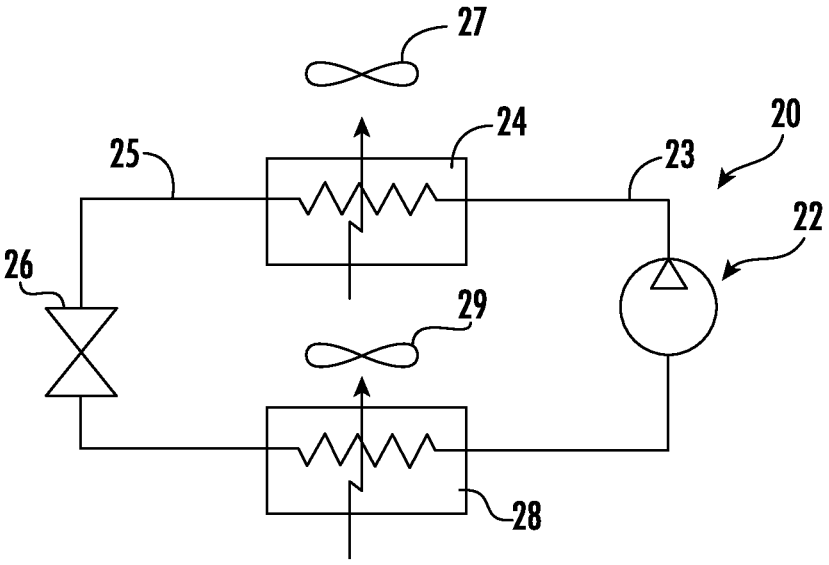
FIG. 1 illustrates an example refrigerant system.

A basic refrigerant system 20 is illustrated in FIG. 1 and includes a compressor 22 delivering refrigerant into a discharge line 23 leading to a heat exchanger 24, such as a condenser for subcritical applications and a gas cooler for trans-critical applications. The heat is transferred in the heat exchanger 24 from the refrigerant to a secondary loop fluid, such as ambient air, with a fan 27. The high pressure, but cooled, refrigerant passes into a refrigerant line 25 downstream of the heat exchanger 24 and through an expansion device 26, where it is expanded to a lower pressure and temperature. Downstream of the expansion device 26, the refrigerant flows through an evaporator 28 and back to the compressor 22. A fan 29 draws air to be conditioned through the evaporator 28.

This basic configuration can be used in a number of applications, such as in residential systems and in rooftop systems. When used with a residential system, the evaporator 28 is located inside a residence and the fan 29 draws air through the evaporator 28. Additionally, the fan 29 may be associated with a separate heating system for the residence.

When used with a roof top system, the refrigerant system 20 is located on a rooftop or an exterior of a building. In this configuration, refrigerant system 20 includes an indoor section that draws air from inside the building and conditions it with the evaporator 28 and directs the air back into the building. Additionally, the refrigerant system 20 for the rooftop application would include an outdoor section with the fan 27 drawing ambient air through the heat exchanger 24 to remove heat from the heat exchanger 24 as described above.

Figure 2:
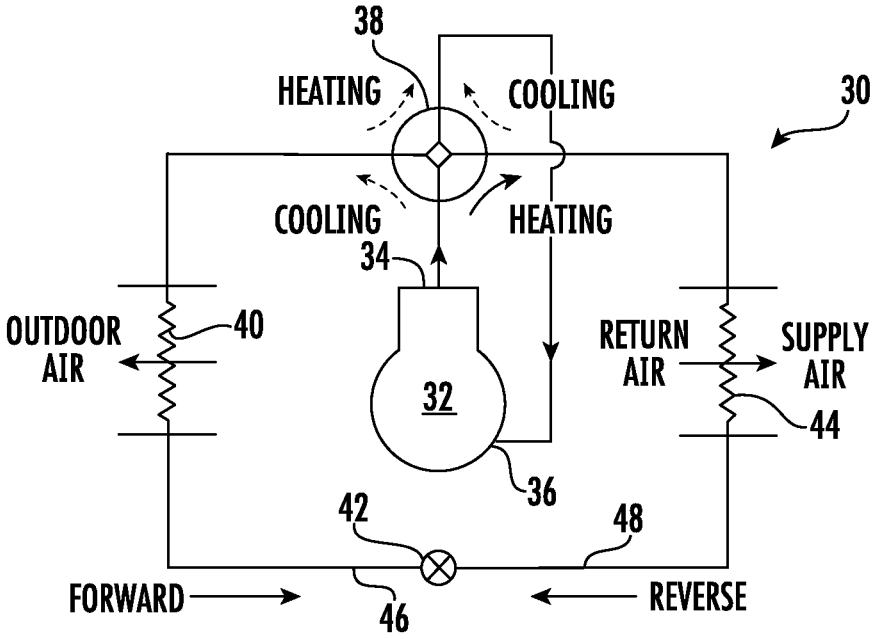
FIG. 2 illustrates an example heat pump system.

FIG. 2 illustrates another type of refrigeration system, such as a heat pump 30, capable of operating in both cooling and heating modes. The heat pump 30 includes a compressor 32. The compressor 32 delivers refrigerant through a discharge port 34 that is returned back to the compressor through a suction port 36.

Refrigerant moves through a four-way valve 38 that can be switched between heating and cooling positions to direct the refrigerant flow in a desired manner (indicated by the arrows associated with valve 38 in FIG. 2) depending upon the requested mode of operation, as is well known in the art. When the valve 38 is positioned in the cooling position, refrigerant flows from the discharge port 34 through the valve 38 to an outdoor heat exchanger 40 where heat from the compressed refrigerant is rejected to a secondary fluid, such as ambient air. A fan may be used in associate with the outdoor heat exchanger 40.

The refrigerant flows from the outdoor heat exchanger 40 through a first fluid passage 46 into an expansion device 42. The refrigerant when flowing in this forward direction expands as it moves from the first fluid passage 46 to a second fluid passage 48 thereby reducing its pressure and temperature. The expanded refrigerant flows through an indoor heat exchanger 44 to accept heat from another secondary fluid and supply cold air indoors. A fan may be associated with the indoor heat exchanger 44. The refrigerant returns from the indoor heat exchanger 44 to the suction port 36 through the valve 38.

When the valve 38 is in the heating position, refrigerant flows from the discharge port 34 through the valve 38 to the indoor heat exchanger 44 where heat is rejected to the indoors. The refrigerant flows from the indoor heat exchanger 44 through second fluid passage 48 to the expansion device 42. As the refrigerant flows in this reverse direction from the second fluid passage 48 through the expansion device 42 to the first fluid passage 46, the refrigerant flow is more restricted in this direction as compared to the forward direction. The refrigerant flows from the first fluid passage 46 through the outdoor heat exchanger 40, four-way valve 38 and back to the suction port 36 through the valve 38.

Figure 3:
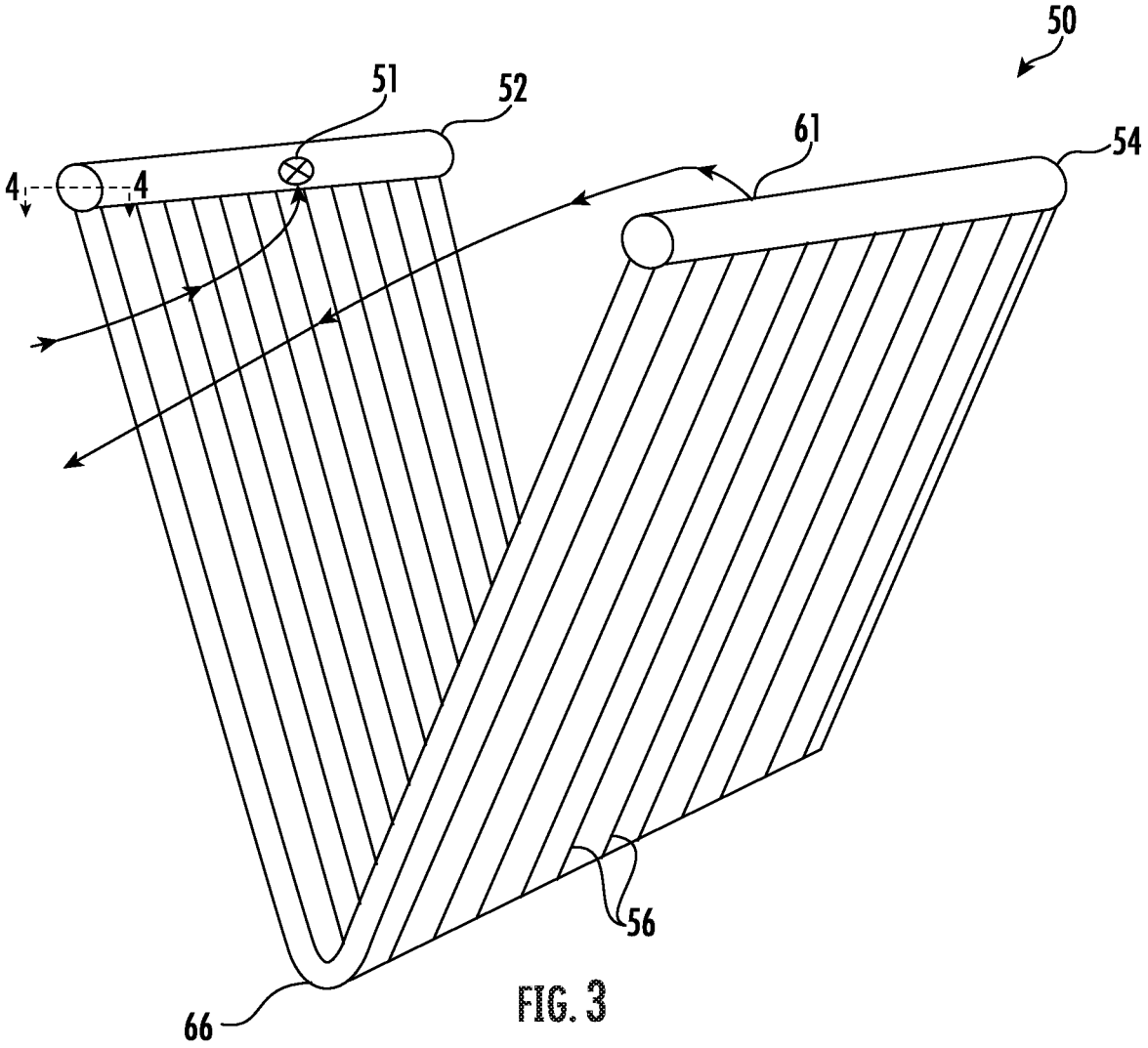
FIG. 3 illustrates an example heat exchanger for use in either the system of FIG. 1 or FIG. 2.

FIG. 3 illustrates an example heat exchanger 50. The heat exchanger 50 could be used in the refrigerant system 20 as the evaporator 28 or with the heat pump 30 in place of the outdoor heat exchanger 40 or the indoor heat exchanger 44. The heat exchanger 50 includes an inlet manifold 52 fluidly connected to an outlet manifold 54 through a plurality of heat exchanger tubes 56. In the illustrated example, the heat exchanger 50 is a "V" shaped heat exchanger with the plurality of heat exchanger tubes 56 including a first portion 56A that extend from the inlet manifold 52 towards a bend 66 and a second portion 56B that extend from the bend 66 to the outlet manifold 54. The first portion 56A, bend 66, and second portion 56B could be one continuous tube, or the separate parts joined together to form a single tube. Alternatively, the heat exchanger 50 could be "U" with the bend 66 having a larger radius of curvature than the "V" shaped bend 66 shown in FIG. 3.

Figure 4:
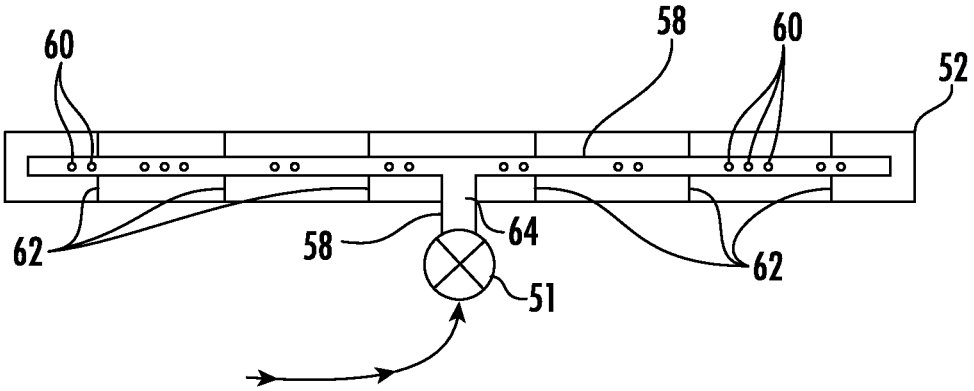
FIG. 4 illustrates a cross-sectional view of an inlet manifold taken along line 4-4 of FIG. 3.

As shown in FIGS. 3 and 4, the inlet manifold 52 receives refrigerant from a distribution insert 58 that extends through an inlet opening 64 in a sidewall of the inlet manifold 52. In the illustrated example, the inlet opening 64 is located at a mid-portion of the inlet manifold 52. However, the inlet opening 64 could be located at another location inward from opposing ends of the inlet manifold. The distribution insert 58 is "T" shaped with an inlet portion extending through the inlet opening 64 in the sidewall of the inlet manifold 52 that separates into two branches that each extend towards opposite ends of the inlet manifold 52.

In the illustrated example, an expansion device 51, such as one of the expansion devices 26, 42, is located at an inlet to the distribution insert 58. The expansion device 51 could include an electronic expansion valve ("EXV"), a thermal expansion valve ("TXV"), or a blocked TXV. When a blocked TXV is used, the expansion device 51 is located directly against the inlet manifold 52 and connected to the inlet manifold 152 through brazing, welding, or with a mechanical attachment, such as with a bolt and gasket. The mechanical attachment includes the feature of reduced complexity for servicing or replacing the valve. Additionally, the blocked TXV could be made of aluminum as opposed to brass to reduce the cost of the system.

The distribution insert 58 includes a plurality of distribution orifices 60 that allow the refrigerant to flow from distribution insert 58 into a cavity defined by the inlet manifold 52. A plurality of partitions 62 are located within the inlet manifold 52 and separate the distribution orifices 60 from an adjacent distribution orifices 60 or from adjacent groups of distribution orifices 60. The number and density of distribution orifices 60 located between adjacent partitions 62 can vary depending on the operating conditions of the heat exchanger 50 to control refrigerant flow into the plurality of heat exchanger tubes 56.

The outlet manifold 54 includes a refrigerant outlet 61 located in a mid-portion of the outlet manifold 54. However, the refrigerant outlet 61 could be located outward from a mid-portion of the outlet manifold and inward from either of the opposing ends of the outlet manifold.

Figure 5:
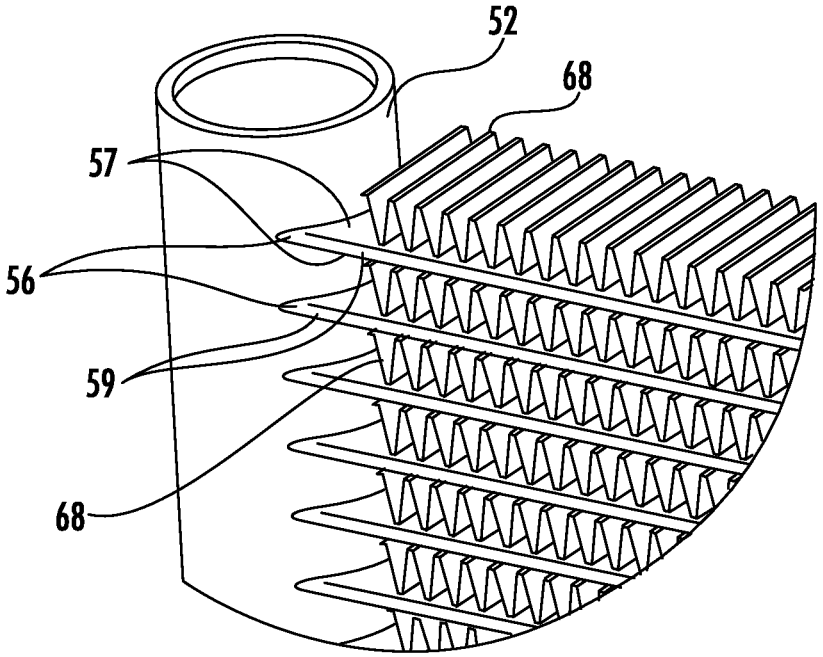
FIG. 5 illustrates an enlarged view of a portion of the heat exchanger of FIG. 3.

As shown in FIG. 5, the plurality of heat exchanger tubes 56 are flat tubes such that opposing longitudinal sides 57 are generally flat and connected by rounded end portions 59. By shaping the plurality of heat exchanger tubes 56 in this configuration, an external surface of the plurality of heat exchanger tubes 56 is increased compared to an internal cross-sectional area to improve heat transfer between the refrigerant passing through the plurality of heat exchanger tubes 56 and a secondary fluid, such as air.

Additionally, when the plurality of heat exchanger tubes 56 are flat tubes, the flat tubes may be formed to include a plurality of channels, or internal passageways that are much smaller than the internal passageways of the tubes in the conventional round-tube plate-fin heat exchanger. In this disclosure, the flat tubes may also comprise mini size multi-port channels, or micro size multi-port channels (otherwise known as microchannel tubes). Hence the flat tube heat exchangers using small size multi-port channels are alternately known as Microchannel Heat Exchanger (FIG. 5) in the art. However, in other constructions of the flat tubes may include one channel, or internal passageway.

Furthermore, the opposing longitudinal sides 57 of the heat exchanger tubes 56 are connected to cooling fins 68 that form a plurality of secondary heat transfer surfaces. In the illustrated example, the cooling fins 68 are arranged in a continuous "W" or serpentine pattern with louvers with turns in the cooling fins 68 being in contact with adjacent ones of the plurality of heat exchanger tubes 56 to improve heat transfer from the refrigerant in the plurality of heat exchanger tubes 56 and the secondary fluid. The cooling fins 68 encompass the width of the heat exchanger tube 56 which also defines the minor dimension of the microchannel heat exchanger and through which the air flows. The cooling fins 68 are positioned along the heat exchanger tubes 56 and solidly coupled to two adjacent flat tubes by a brazing or welding process. The cooling fins 68 could be spaced from the bend 66 (FIG. 3) or continue through the bend 66 to increase the heat transfer surface area for the plurality of heater transfer tubes 56.

Additionally, in the illustrated example, a direction of flow of the refrigerant through the plurality of heat exchanger tubes 56 is generally perpendicular to a direction of flow of the secondary fluid over the heat exchanger tubes 56. However, other configurations of heat exchanger tubes 56 could be utilized with this disclosure.

Figure 6:
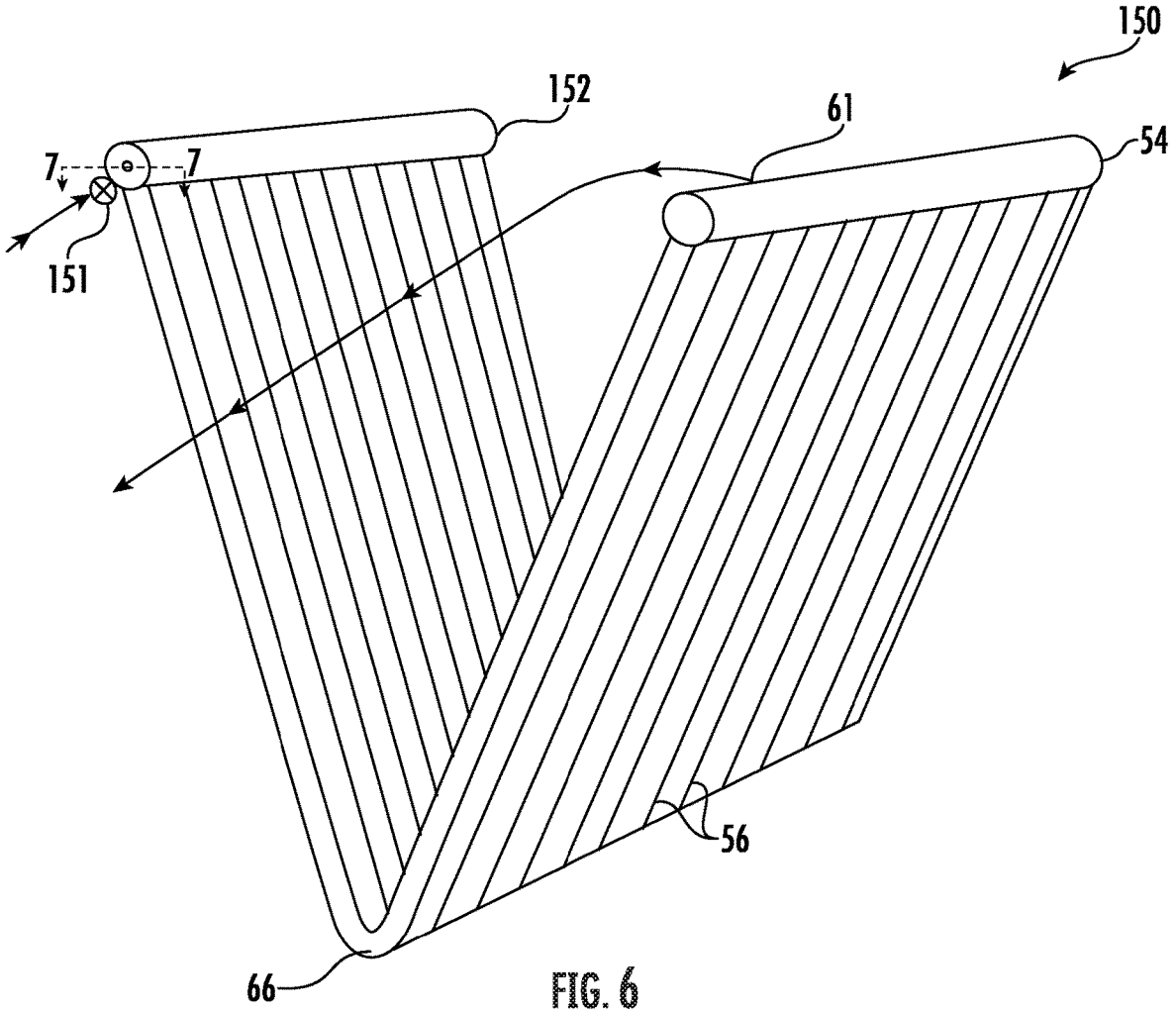
FIG. 6 illustrates another example heat exchanger for use in either the system of FIG. 1 or FIG. 2.

FIG. 6 illustrates another example heat exchanger 150 similar to the heat exchanger 50 except where described below or shown in the Figures. The heat exchanger 150, utilizes the same heat exchanger tubes 56 and outlet manifold 54 as the heat exchanger 50, but with a different inlet manifold 152.

Figure 7:
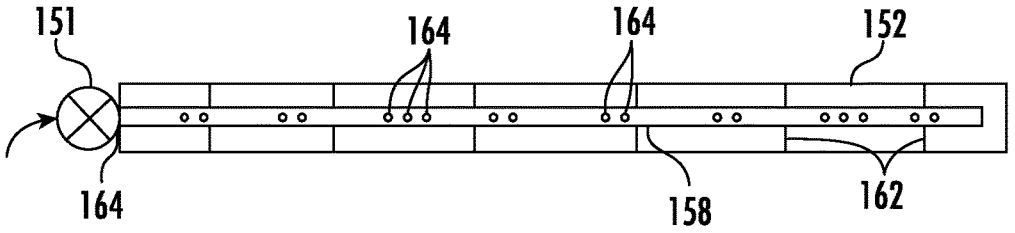
FIG. 7 illustrates a cross-sectional view of an inlet manifold taken along line 7-7 FIG. 6.

As shown in FIGS. 6 and 7, the inlet manifold 152 includes an inlet opening 164 for accepting a distribution tube 158. The distribution insert 158 includes a plurality of distribution orifices 160 that allow the refrigerant to flow from distribution insert 158 into the inlet manifold 52. A plurality of partitions 162 are located within the inlet manifold 162 and separate the distribution orifices 160 from an adjacent distribution orifices 160 or from adjacent groups of distribution orifices 160. The number and density of distribution orifices 160 located between adjacent partitions 162 can vary depending on the operating conditions of the heat exchanger 150 to control refrigerant flow into the plurality of heat exchanger tubes 56.

Additionally, in the illustrated example, the expansion device 151, such as one of the expansion devices 26, 42, is an EXV, a TXV, or a blocked TXV. When a blocked TXV is used, the expansion device 151 is located directly against the inlet manifold 152 and connected to the inlet manifold 152 through brazing, welding, or with a mechanical attachment, such as with a bolt and gasket.

Figure 8:
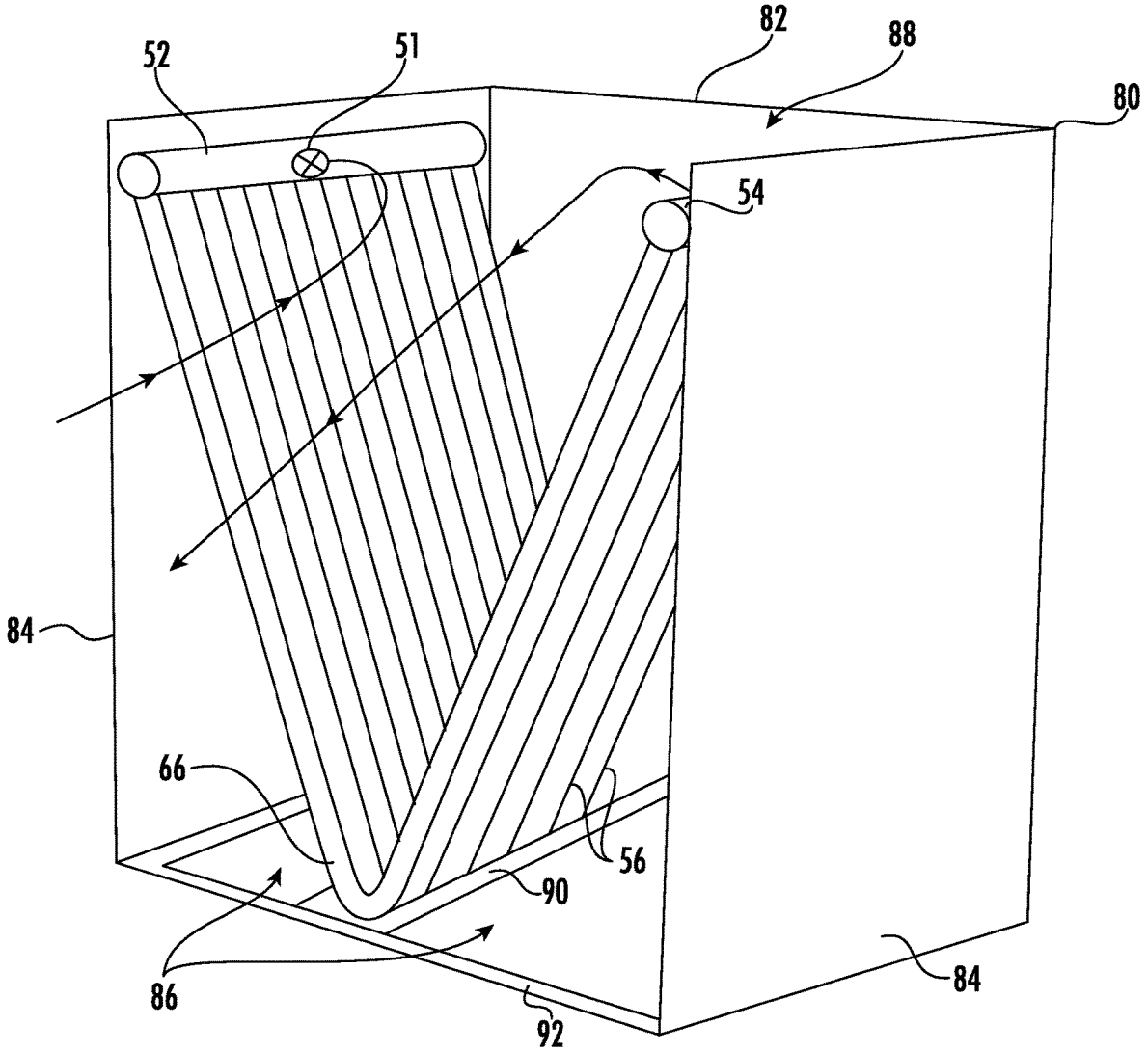
FIG. 8 illustrates a perspective view of the heat exchanger of FIG. 3 located in a housing.
Figure 9:
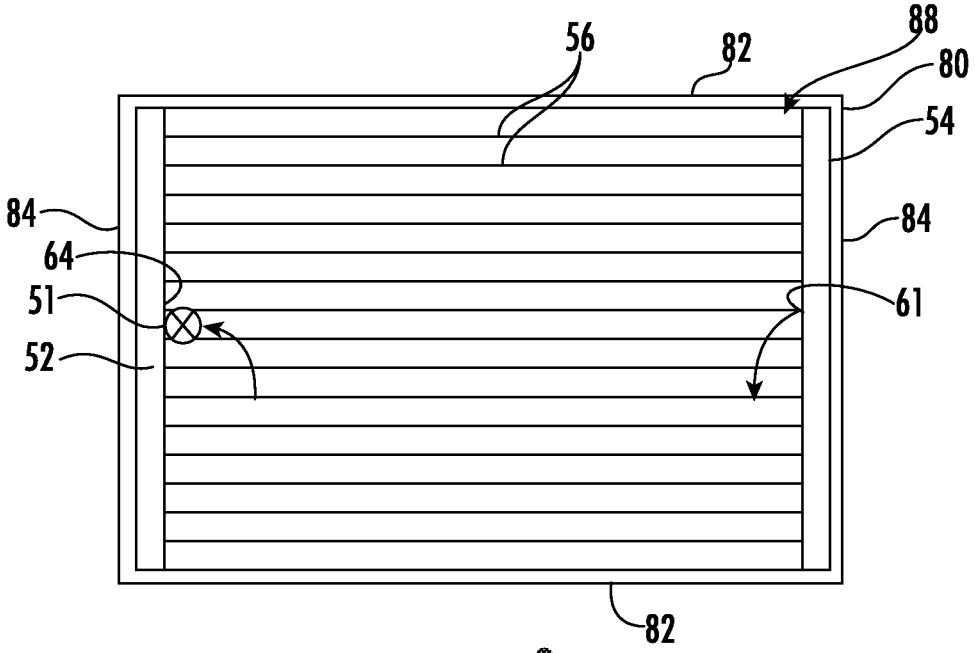
FIG. 9 illustrates a top perspective view of the heat exchanger of FIG. 3 in the housing of FIG. 8.

As shown in FIGS. 8 and 9, the heat exchanger 50 is located within a housing 80. The housing 80 includes a first pair of opposing walls 82 and a second pair of opposing walls. The first pair of opposing walls 82 are located adjacent opposing ends of the inlet manifold 52 and the outlet manifold 54 and the second pair of opposing walls 84 extend along a length of one of the second pair of opposing walls 84. Because the inlet to the inlet manifold 52 and the outlet 61 from the outlet manifold 54 are located inward from opposing ends of the inlet and outlet manifolds 52, 54, respectively, the first pair of opposing walls 82 are located in close proximity to the first pair of opposing walls 82. Additionally, one of the first pair of opposing walls 82 could be a removable panel to allow improved access into the housing to allow for serving or replacement of the heat exchanger 50.

At least one housing inlet opening 86 is located adjacent a first end of the first and second pair of walls 82, 84 to allow a secondary fluid, such as air to travel through the housing 80. A support 90 extends from a perimeter frame 92 and divides the inlet opening 86 into at least two openings 86 and provides support for the plurality of heat exchanger tubes 56. The support 90 and the perimeter frame 92 can be a unitary piece of material or separate pieces that are joined together. The support 90 can also operate as a drain pan for collection condensate. At least one housing outlet opening 88 is located on an opposite side of the plurality of heat exchanger tubes 56 from the at least one inlet opening 86 to allow the secondary heat transfer fluid to exit the housing 80. One additional feature of the close proximity is the elimination of cover plates that enclose opposing ends of the heat exchanger tubes 56, which reduces cost and the number of parts in the heat exchanger assembly of FIGS. 8 and 9.

Furthermore, when the heat exchanger 150 is used in the housing 80, the close proximity of the expansion device 151 relative to the inlet manifold 152 also allows one of the first pair of opposing walls 82 to be located in close proximity to the inlet manifold 152, the heat exchanger tubes 56, and the outlet manifold 54. Therefore, the use of cover plates may be avoided with this configuration as well.

Although the different non-limiting examples are illustrated as having specific components, the examples of this disclosure are not limited to those particular combinations. It is possible to use some of the components or features from any of the non-limiting examples in combination with features or components from any of the other non-limiting examples.

It should be understood that like reference numerals identify corresponding or similar elements throughout the several drawings. It should also be understood that although a particular component arrangement is disclosed and illustrated in these exemplary embodiments, other arrangements could also benefit from the teachings of this disclosure.

The foregoing description shall be interpreted as illustrative and not in any limiting sense. A worker of ordinary skill in the art would understand that certain modifications could come within the scope of this disclosure. For these reasons, the following claim should be studied to determine the true scope and content of this disclosure.

What is claimed is:

1. A heat exchanger assembly comprising:

a plurality of flattened heat exchanger tubes, wherein the plurality of heat exchanger tubes include a bend separating the plurality of heat exchanger tubes between extending in a first plane and extending in a second plane transverse to the first plane;

an inlet manifold in fluid communication with the plurality of heat exchanger tubes and including a distribution insert at least partially extending through an inlet opening in the inlet manifold located inward from opposing ends of the inlet manifold and the distribution insert includes an inlet portion extending through a mid-portion of the inlet manifold and a plurality of distribution orifices spaced along a length of the distribution insert with adjacent sets of the plurality of distribution orifices having a varying number of distribution orifices;

a plurality of partitions is located within the inlet manifold and each partition includes an opening for accepting the distribution insert to fluidly separate the adjacent sets of the plurality of distribution orifices; and an outlet manifold in fluid communication with the plurality of heat exchanger tubes and including an outlet opening spaced inward from opposing ends of the outlet manifold.

2. The assembly of claim 1, wherein the inlet portion of the distribution insert divides into at least two branches that each extend towards a corresponding one of the opposing ends of the inlet manifold.

3. The assembly of claim 1, wherein the inlet opening on the inlet manifold is located at a longitudinal end of the inlet manifold.

4. The assembly of claim 3, further comprising an aluminum bodied expansion device located at the inlet opening on the inlet manifold.

5. The assembly of claim 1, wherein the plurality of heat exchanger tubes are microchannel heat exchanger tubes.

6. The assembly of claim 1, wherein the first plurality of heat exchanger tubes define one of a "V" shape or a "U" shape with the bend.

7. An assembly comprising:

a housing including a first pair of opposing walls and a second pair of opposing walls;

a heat exchanger assembly at least partially located within the housing and comprising:

a plurality of flattened heat exchanger tubes, wherein the plurality of heat exchanger tubes include a bend separating the plurality of heat exchanger tubes between extending in a first plane and extending in a second plane transverse to the first plane;

an inlet manifold in fluid communication with the plurality of heat exchanger tubes and including a distribution insert at least partially extending through an inlet opening in an exterior of the inlet manifold and the distribution insert includes a plurality of distribution orifices;

a plurality of partitions is located within the inlet manifold and each partition includes an opening for accepting the distribution insert to fluidly separate adjacent sets of the plurality of distribution orifices; and an outlet manifold in fluid communication with the plurality of heat exchanger tubes and including an outlet opening in an exterior of the outlet manifold and spaced from opposing ends of the outlet manifold;

wherein the plurality of heat exchanger tubes are microchannel heat exchanger tubes and the adjacent sets include a varying number of distribution orifices.

8. The assembly of claim 7, wherein opposing ends of the inlet manifold and the outlet manifold are located adjacent the first pair of opposing walls.

9. The assembly of claim 8, wherein a mid-portion of the outlet manifold is located adjacent one of the second pair of opposing walls.

10. The assembly of claim 9, wherein one of the first pair of walls includes an access panel.

11. The assembly of claim 9, wherein the distribution insert includes an inlet portion extending through a mid-portion of the inlet manifold.

12. The assembly of claim 11, wherein the inlet portion of the distribution insert divides into at least two branches that each extend towards a corresponding one of the opposing ends of the inlet manifold.

13. The assembly of claim 9, wherein the inlet opening on the inlet manifold is located at an end of the inlet manifold.

14. The assembly of claim 13, further comprising an expansion device located at the inlet opening on the inlet manifold.

15. The assembly of claim 14, wherein the expansion device is an aluminum bodied expansion device.

16. The assembly of claim 7, wherein the first plurality of heat exchanger tubes define one of a "V" shape or a "U" shape with the bend and the bend is located adjacent a drain pan in the housing.

* * * * *